US006206563B1

(12) United States Patent
Dombre et al.

(10) Patent No.: US 6,206,563 B1
(45) Date of Patent: Mar. 27, 2001

(54) DEVICE FOR LEAKPROOF FASTENING OF A WATCH GLASS TO A WATCH CASE

(75) Inventors: Christian Dombre, Annemasse; William Passaquin, Thonon-les-Bains, both of (FR)

(73) Assignee: Montres Rolex S.A., Geneva (CH)

( * ) Notice: Subject to any disclaimer, the term of this patent is extended or adjusted under 35 U.S.C. 154(b) by 0 days.

(21) Appl. No.: 09/515,904

(22) Filed: Feb. 29, 2000

(30) Foreign Application Priority Data

Mar. 3, 1999 (EP) ..... 99810182
Mar. 26, 1999 (EP) ..... 99810263

(51) Int. Cl.[7] ..... G04B 37/00; G04B 39/00
(52) U.S. Cl. ..... 368/294
(58) Field of Search ..... 368/88, 276, 291, 368/294–296

(56) References Cited

U.S. PATENT DOCUMENTS 2,854,815 * 10/1958 Piquerez .
4,456,388 * 6/1984 Matsumoto ..... 468/294
4,668,101 5/1987 Wuthrich .

FOREIGN PATENT DOCUMENTS 583 438 12/1976 (CH) .
653 844 1/1986 (CH) .
28 17 770 11/1978 (DE) .

OTHER PUBLICATIONS

Patent Abstracts of Japan, vol. 006, No. 129 (P–128), Jul. 15, 1982, and JP 57 054883 A (Seiko Epson Corp), Apr. 1, 1982 *abrege*.

* cited by examiner

*Primary Examiner*—Vit Miska
(74) *Attorney, Agent, or Firm*—Henderson & Sturm LLP

(57) ABSTRACT

A device comprising an annular seal having an annular projection engaged into a groove in the edge of the watch glass is disclosed. The lower part of the seal, said lower part having a bulge, engages onto a surface of the housing and is compressed radially by the bezel. The inner lateral surface of the bezel, said surface being fitted around this seal, comprises two concentric cylindrical surfaces of different cross sections, the surface of larger cross section being that which is adjacent to the base of the bezel, these cross sections being slightly smaller than the cross sections of the outer lateral face of the seal and of the bulge in the non-compressed state. The base of the outer lateral surface of the upper part of the housing has a groove in order to receive a portion of the seal, said portion being deformed by the bezel, thus ensuring the axial blocking of this seal.

7 Claims, 2 Drawing Sheets

DEVICE FOR LEAKPROOF FASTENING OF A WATCH GLASS TO A WATCH CASE

FIELD OF THE INVENTION

The present invention relates to a device for the leakproof fastening of a watch glass to a watch case, comprising an annular seal of cylindrical general shape, made of a compressible material and having an inner annular projection at the upper end of this annular seal, an annular groove made on that edge of the watch glass into which this annular projection is engaged, an outer lateral surface made on the upper part of the housing in order to receive the lower part of the inner face of said annular seal, the base of which comes into abutment against a bearing surface, and a bezel fitted around said seal, at the same time compressing the latter radially.

Devices are already known for the leakproof fastening of a glass consisting of hard material, such as toughened glass or sapphire, in which the glass consisting of hard material is fastened in a ring produced from a material which is soft in relation to the watch glass and also in relation to the metal of the case to which it is to be fastened. This ring usually consists of organic glass, such as Plexiglass.

DESCRIPTION OF THE PRIOR ART

A fastening device of this type is described in CH 519 193, in which the watch glass is accommodated in a ring consisting of organic glass, the entire assembly subsequently being introduced by mounting into a receptacle of a bezel housing, the deformations resulting from the mounting operation being absorbed by the ring consisting of organic glass which also ensures the leakproofing of the fastening. A false bezel may be fastened to the bezel housing in order to conceal the fastening ring of the watch glass. In a variant, the fastening ring is accommodated in an annular groove made in the edge of the watch glass, so as not to project from the periphery of the latter and thus not be visible.

Such a fastening device is necessary for the annular seal surrounding the watch glass to be subjected to stress before this assembly is fastened in an orifice of the housing. The removal of this assembly presents serious problems, since the prestressed seal is entirely embedded in the housing and the glass of sapphire or toughened-glass type cannot be deformed.

CH 583 438 proposed a solution which does not have the abovementioned disadvantages and in which the annular seal made of relatively soft glass, which surrounds the watch glass, is engaged around a lateral surface made on the upper end of the housing, around the raised portion, and is compressed radially against this lateral surface by the bezel mounted around this seal. In a preferred embodiment, not described in this patent, the bezel extends over the entire height of the annular seal, so that the upper part of this seal is compressed between the bezel and the watch glass and so that the lower part of this seal is compressed between this bezel and the lateral surface of the housing on which it is engaged.

Although this fastening method has proved successful for many years, particularly with regards leakproofing, it became clear that its design was capable of being improved even further in many respects.

Thus, in the abovementioned fastening system, only the frictional force makes it possible to ensure that the annular seal is fastened to the lateral surface of the housing, so that the seal must have sufficient rigidity, giving rise to pronounced stresses on the other parts, particularly giving rise to a torque tending to deform the raised portion and the bezel.

The same surface of the bezel serves for clamping the seal around the watch glass and around the lateral surface of the housing. In view of the many manufacturing tolerances in the various elements involved in this fastening, the force necessary for removing the bezel may vary in a ratio of 1 to 4. In view of the differences in the frictional forces occurring as a result of these tolerance variations, the position of the bezel after mounting may change slightly from one piece to another, thus having effects on the compression of the annular seal.

During the mounting of the bezel, the seal undergoes deformations in the region of the watch glass which are greater than those determined by leakproofing. If this seal is clamped firmly, there is a risk that it will form a bead which is interposed between the housing and the bezel and prevents the latter from being laid against the housing. It is also possible, in the event of a sharp compression of the annular seal, that the latter is deformed into the space provided between the watch glass and the housing.

As a consequence of the design of the assembly operation, in which, in the assembled position, the bezel is held solely by friction around a piece consisting of compressible material, the bezel remains subject to a force tending to cause it to rise.

Finally, the injection points can be located only in a visible zone or in a contact zone and are therefore annoying in both cases.

BRIEF SUMMARY OF THE INVENTION

The object of the present invention is partly to overcome the abovementioned disadvantages.

To achieve this, the subject of this invention is a device for the leakproof fastening of a watch glass to a watch case according to claim 1.

One of the essential advantages of the present invention is due to the fact that the base of the annular seal is retained on the housing by anchoring and no longer by friction. Consequently, the extreme values of the force necessary for removing the bezel come within a somewhat limited range, in spite of the disparity of the clamping values inherent in the manufacturing tolerances of the various elements.

Another great advantage is due to the fact that the annular seal is no longer radially compressed uniformly over its entire height, but that two separate compression zones are formed, one in the region of the watch glass and the other in the region of the fitting surface, adjacent to the upper edge of the housing. Thus, during the mounting of the bezel, its base does not compress the upper part of the seal, thus avoiding the risk of formation of a bead which comes into place between the bezel and the housing.

That part of the annular seal which is located between the lower face of the watch glass and the upper edge of the housing is not compressed, or compressed very little, radially, thus avoiding the risk of being deformed into the free space separating the watch glass from the housing. The radial compressions induced in the two clamping zones are not necessarily the same, but may be adapted to requirements independently in each zone. Since the hold of the assembled elements is not attributable solely to the frictional forces, it is then possible to use a seal consisting of a less rigid material, thus making it possible to reduce the stresses exerted on the other elements and, in particular, on the raised portion.

Contrary to the seal of the fastening device of the prior art, in the present invention, when the seal is injected, the injection points of the seal may be arranged, particularly with regard to opaque seals, in that portion of its outer face which is located between the bulge of the base of the seal and the part of smallest diameter of the inner face of the bezel. After mounting, this portion is, in fact, concealed by the bezel and also forms a non-functional zone of the seal, since said portion is not in contact with any surface of the bezel.

It can be seen that, by preserving the same general principle for the leakproof fastening of the watch glass as that known from the prior art, the present invention makes it possible to afford substantial improvements which are appreciable, in particular, during the assembly operations and also in terms of maintenance, since demounting is thereby made easier by a narrower dispersion of the values of the forces for removing the bezel, without any impairment in leakproofing efficiency, on the contrary.

BRIEF DESCRIPTION OF THE DRAWING

The invention will be understood more clearly from a reading of the following description relating to an embodiment and a variant of the device for the leakproof fastening of a watch glass, which is the subject of this invention, and with the aid of the accompanying drawings in which.

DETAILED DESCRIPTION OF THE INVENTION

Figure 1:
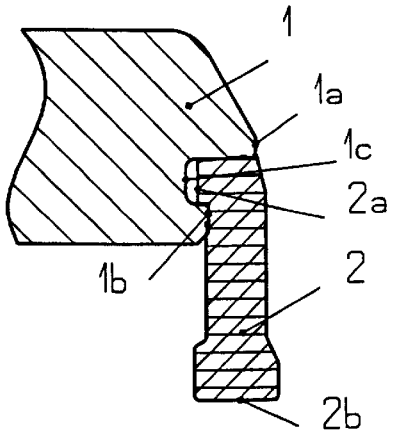
FIGS. 1 to 4 are partial views in diametral section, illustrating four steps in the fastening of a watch glass according to this embodiment.
Figure 2:
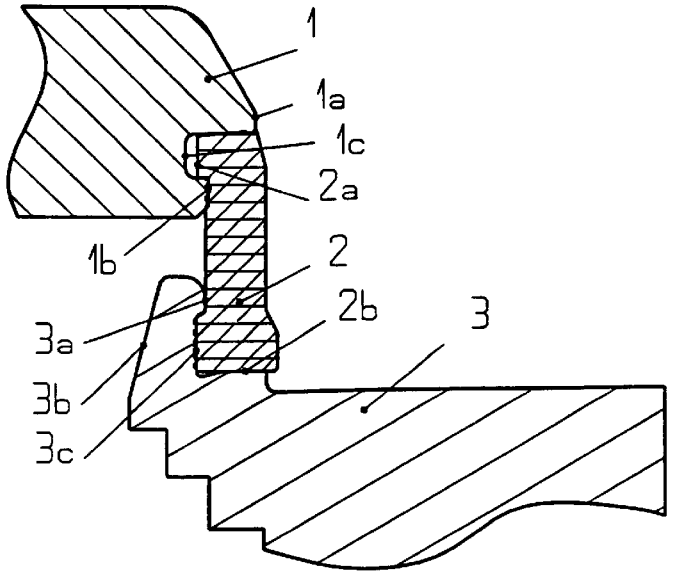
Figure 3:
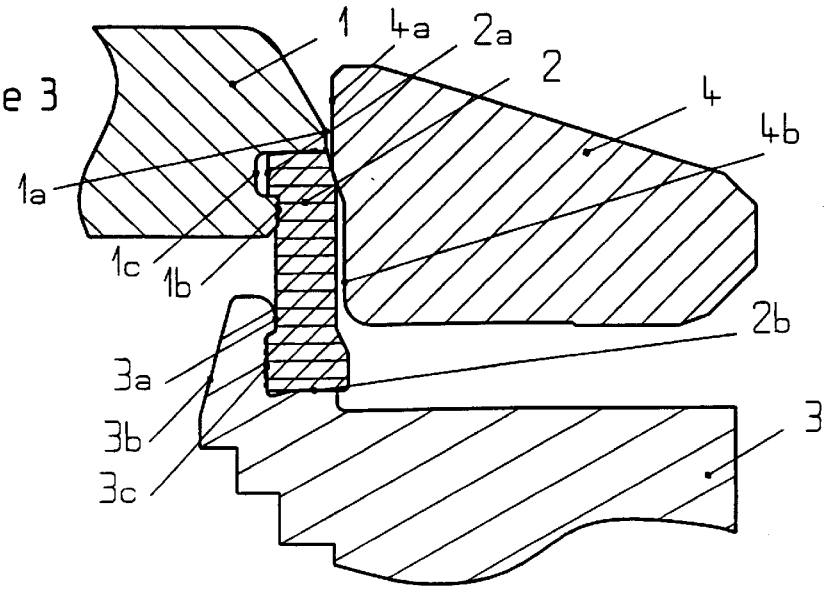
Figure 4:
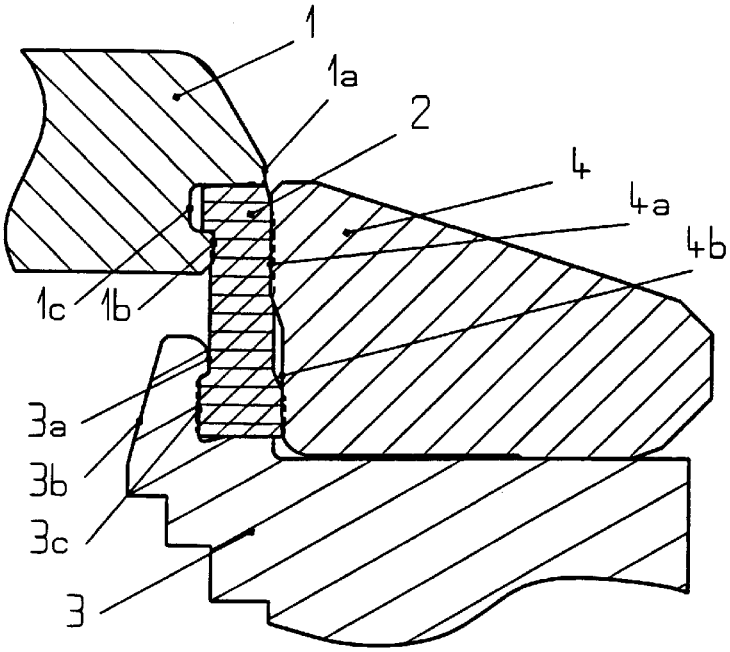

In the embodiment illustrated in FIGS. 1 to 4, there can be seen a watch glass 1, an annular seal 2 of cylindrical general shape, the upper part of a housing 3 and a bezel 4 mounted around the outer face of the annular seal 2. This watch glass, which preferably consists of a hard material, such as toughened glass and, more advantageously, sapphire glass, is machined from a sheet. The edge of the watch glass 1 is delimited by two portions of different diameters, one of large diameter 1*a* and the other of smaller diameter 1*b*, adjacent to the lower face of the watch glass 1. An annular groove 1*c* separates these two portions 1*a* and 1*b*.

The annular seal 2 has an inner annular projection 2*a* adjacent to its upper edge. This projection 2*a* penetrates into the annular groove 1*c* of the watch glass 1, whilst the portion of small diameter 1*b* penetrates slightly into the inner face of the annular seal 2. To make understanding easier, in all the figures the deformed portions of the annular seal 2 have been illustrated in their non-deformed state by broken lines.

The lower part of this annular seal 2 is engaged around a lateral interlocking surface 3*a* made at the upper end of the housing 3 and located substantially at the same level as the raised portion 3*b*. The base of this lateral interlocking surface 3*a* has an annular groove 3*c*.

A swollen heal 2*b* projects symmetrically on either side of the inner and outer lateral faces at the base of the annular seal 2. That part of this swollen heal 2*b* which projects on the inside of the annular seal 2 engages into the annular groove 3*c* of the lateral interlocking face 3*a*.

The inner lateral face of the bezel 4 comprises two cylindrical portions, a lower portion 4*b* of larger diameter and an upper portion 4*a* of smaller diameter. The diameter of the lower portion 4*b* of larger diameter of the inner lateral face of the bezel is greater than the diameter of the outer lateral face of the annular seal 2, but smaller than the outside diameter of its swollen heal 2*b*, whereas the diameter of the upper portion 4*a* is smaller than the diameter of the outer lateral face of the annular seal 2.

Thus, during the mounting of the bezel 4, the lower portion 4*b* of the bezel engages freely around the annular seal, since the diameter of this lower portion is larger than that of the annular seal 2. Only when this lower portion 4*b* comes level with the swollen heal 2*b* does it compress the latter in the annular groove 3*c* of the lateral face 3*a* of the housing 3, thus fastening this seal 2 to the latter.

Simultaneously with the compression of the swollen heal 2*b* by the lower portion 4*b* of the bezel 4, its upper portion 4*a*, having a smaller diameter than the seal 2, compresses the upper part of the latter, that is to say essentially that part which is located in the region of the watch glass 1, at the same time pressing the inner annular projection 2*a* of the seal 2 into the annular groove 1*c* of the watch glass 1 and also causing that part of small diameter 1*b* of the watch glass 1, said part being located below the inner annular projection 2*a*, to penetrate slightly into the seal 2.

It can be seen that, with this device, the fastening of the seal 2 is assured at its two ends, on the one hand, by the penetration of the inner annular projection 2*a* into the annular groove 1*c* of the watch glass 1 and, on the other hand, by penetration of a portion of the swollen heal 2*b* of this seal 2 into the annular groove 3*c* of the housing. In both cases, this engagement of the seal into the annular grooves 1*c* and 3*c* is accompanied by the centripetal radial pressure exerted on the annular seal 2 by the bezel 4. This seal is therefore no longer held on the housing simply by friction, but by hooking. This fastening method thus makes it possible to use a softer material than in the abovementioned prior art. Whereas the seal has hitherto been produced from 6.6 polyamide, the modulus of elasticity of which is between 2100 and 3000 MPa, in the present invention it may consist of polyamide, in particular PBT or POM, the modulus of elasticity of which is between 1000 and 3000 MPa.

Figure 5:
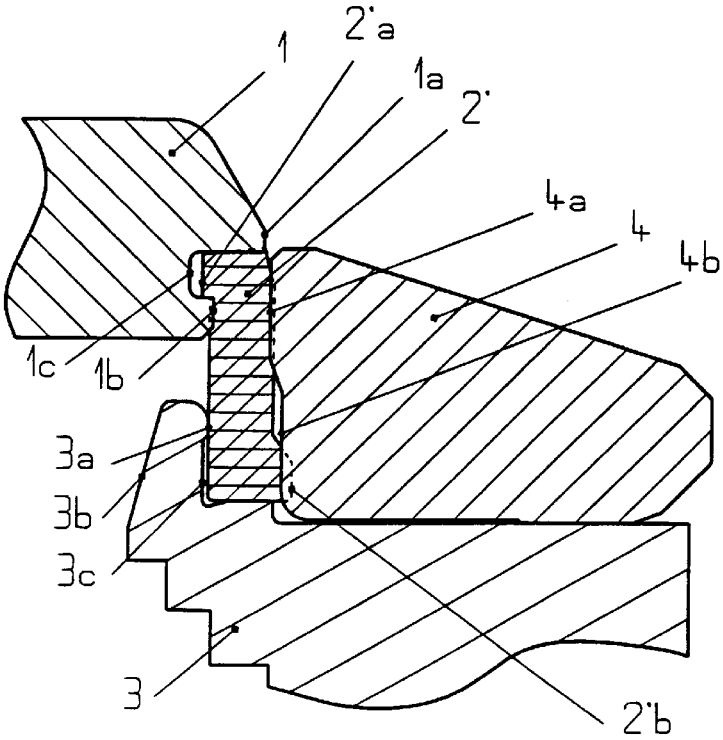
FIG. 5 is a view in diametral section, similar to that of FIG. 4, of a variant.

The variant illustrated in FIG. 5 differs from the embodiment described above only in the shape of the annular seal 2' and, more specifically, in the shape of the swollen heal 2'*b*. Contrary to the swollen heal 2*b*, the latter projects only on the outer lateral face of the annular seal 2', leaving the inner lateral face of this cylindrical annular seal 2' downward from the base of the inner annular projection 2'*a* engaged into the annular groove 1*c* of the watch glass 1. The hooking of the annular seal 2' in the annular groove 3*c* of the housing 3 occurs as a result of the deformation of the base of this annular seal 2', said deformation being induced when the lower part of the bezel 4*b* engages onto that part of the swollen heal projecting on the outer lateral face of the seal and imparts centripetal radial compression to said part.

This variant has the advantage of making it easier to remove the annular seal 2' from the mold during its injection, while at the same time preserving the system of anchoring this seal on the housing. This variant also allows the mounting and demounting of the annular seal 2' to be made easier.

As can be seen, the changes made to the fastening device of the prior art give rise to virtually no complication either as regards the operations of machinery or injecting the various elements or as regards the mounting operations, so that the great advantages which have been seen are obtained, without entailing any disadvantage and without the need for an additional operation either in the manufacturing program or in the mounting operations.

Advantageously, the injection points of the seal 2 or 2' will be located opposite that part 4*b* of the bezel 4 which has the largest inside diameter and on the outer face of the annular seal 2 or 2', said outer face being located between the heal 2*b* or 2'*b* and the top of the part 4*b* of the bezel 4. Thus, these injection points are not visible and are not located in a contact zone of the annular seal 2 or 2'.

What is claimed is:

1. A device for the leakproof fastening of a watch glass to a watch housing, comprising an annular seal of a cylindrical general shape, said annular seal consisting of a compressible material having an inner annular projection at the upper end of said annular projection at the upper end of said annular seal, an annular groove positioned on an edge of the watch glass into which said annular projection is engaged, an outer lateral surface made on the upper part of the housing in order to receive the lower part of the inner face of said annular seal, the base of which comes into abutment against a bearing surface of the housing, and bezel fitted around said seal, at the same time compressing the latter radially, wherein the base of said annular seal has an annular bulge projecting at least from its outer lateral face, and wherein the inner lateral surface of the bezel fitted around this seal comprises two concentric cylindrical surfaces of different cross sections, the cylindrical surface of larger cross section being adjacent to the base of the bezel, these cross sections being slightly smaller than the cross sections of the outer lateral face of said annular seal and of said annular bulge in the non-compressed state, the base of said outer lateral surface of the upper part of the housing having an annular groove in order to receive a portion of said annular seal, said portion being deformed as a result of the fitting of the bezel, thereby ensuring the axial blocking of this annular seal.

2. The device according to claim 1, wherein said annular bulge projects on either side of the inner and outer cylindrical faces of said annular seal.

3. The device according to claim 1, wherein the injection points of said annular seal are located on its outer cylindrical face between said annular bulge and the part where the inside diameter of the bezel becomes smaller.

4. The device according to claim 1, wherein said annular seal consists of a polymedic material, the modulus of elasticity of which is between 1000 Mpa and 3000 Mpa.

5. The device according to claim 2, wherein the injection points of said annular seal are located on its outer cylindrical face between said annular bulge and the part where the inside diameter of the bezel becomes smaller.

6. The device according to claim 2, wherein said annular seal consists of a polymedic material, the modulus of elasticity of which is between 1000 Mpa and 3000 Mpa.

7. The device according to claim 3, wherein said annular seal consists of a polymedic material, the modulus of elasticity of which is between 1000 Mpa and 3000 Mpa.

* * * * *

UNITED STATES PATENT AND TRADEMARK OFFICE

CERTIFICATE OF CORRECTION

PATENT NO. : 6,206,563 B1
DATED : March 27, 2001
INVENTOR(S) : Christian Dombre and William Passaquin It is certified that error appears in the above-identified patent and that said Letters Patent is hereby corrected as shown below:

Title page,
Item 30, Foreign Application Priority Data, delete "Mar. 26, 1999 (EP) 99810263".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*